US009435011B2

(12) United States Patent
Holcomb et al.

(10) Patent No.: US 9,435,011 B2
(45) Date of Patent: Sep. 6, 2016

(54) CREEP-RESISTANT, COBALT-FREE ALLOYS FOR HIGH TEMPERATURE, LIQUID-SALT HEAT EXCHANGER SYSTEMS

(71) Applicant: UT-Battelle, LLC, Oak Ridge, TN (US)

(72) Inventors: David E. Holcomb, Oak Ridge, TN (US); Govindarajan Muralidharan, Knoxville, TN (US); Dane F. Wilson, Oak Ridge, TN (US)

(73) Assignee: UT-Battelle, LLC, Oak Ridge, TN (US)

( * ) Notice: Subject to any disclaimer, the term of this patent is extended or adjusted under 35 U.S.C. 154(b) by 120 days.

(21) Appl. No.: 13/962,197

(22) Filed: Aug. 8, 2013

(65) Prior Publication Data

US 2015/0044088 A1 Feb. 12, 2015

(51) Int. Cl.

| | |
|---|---|
| ***C22C 19/05*** | (2006.01) |
| ***C22C 19/00*** | (2006.01) |
| ***C22F 1/10*** | (2006.01) |

(52) U.S. Cl.

CPC ..... *C22C 19/057* (2013.01); *C22C 19/007* (2013.01); *C22F 1/10* (2013.01)

(58) Field of Classification Search

CPC ..... C22C 19/057; C22C 19/007

See application file for complete search history.

(56) References Cited

U.S. PATENT DOCUMENTS

| | | | | |
|---|---|---|---|---|
| 2,684,299 A | | 7/1954 | Binder | |
| 3,030,206 A | | 4/1962 | Buck, Jr. | |
| 3,416,916 A | | 12/1968 | Herchenroeder | |
| 3,444,058 A | | 5/1969 | Mellors et al. | |
| 3,811,960 A | | 5/1974 | Parry et al. | |
| 3,917,463 A | | 11/1975 | Doi et al. | |
| 3,985,582 A | | 10/1976 | Bibring et al. | |
| 4,194,909 A | | 3/1980 | Ohmura et al. | |
| 4,476,091 A | | 10/1984 | Klarstrom | |
| 4,512,817 A | | 4/1985 | Duhl et al. | |
| 4,652,315 A | | 3/1987 | Igarashi et al. | |
| 4,740,354 A | | 4/1988 | Watanabe et al. | |
| 4,765,956 A | | 8/1988 | Smith et al. | |
| 4,818,486 A | * | 4/1989 | Rothman et al. | 420/442 |
| 4,820,359 A | | 4/1989 | Bevilacqua et al. | |
| 4,877,461 A | * | 10/1989 | Smith et al. | 148/677 |

(Continued)

FOREIGN PATENT DOCUMENTS

| | | | | |
|---|---|---|---|---|
| AU | WO 9206223 A1 | * | 4/1992 | B21B 27/00 |
| CA | 706339 | | 3/1965 | |
| CA | 1215255 | | 12/1986 | |

OTHER PUBLICATIONS

Freche, Application of Powder Metallurgy to an Advanced-Temperature Nickel-base Alloy, NASA-TRW VI-A, National Aeronautics and Space Administration, 1971, pp. 1-24.

(Continued)

*Primary Examiner* — Rebecca Lee

(74) *Attorney, Agent, or Firm* — Fox Rothschild LLP

(57) ABSTRACT

An essentially Fe- and Co-free alloy is composed essentially of, in terms of weight percent: 6.0 to 7.5 Cr, 0 to 0.15 Al, 0.5 to 0.85 Mn, 11 to 19.5 Mo, 0.03 to 4.5 Ta, 0.01 to 9 W, 0.03 to 0.08 C, 0 to 1 Re, 0 to 1 Ru, 0 to 0.001 B, 0.0005 to 0.005 N, balance Ni, the alloy being characterized by, at 850° C., a yield strength of at least 25 Ksi, a tensile strength of at least 38 Ksi, a creep rupture life at 12 Ksi of at least 25 hours, and a corrosion rate, expressed in weight loss [g/(cm$^2$ sec)]$10^{-11}$ during a 1000 hour immersion in liquid FLiNaK at 850° C., in the range of 3 to 10.

12 Claims, 7 Drawing Sheets

(56) References Cited

U.S. PATENT DOCUMENTS

| | | | | |
|---|---|---|---|---|
| 5,077,006 | A | 12/1991 | Culling | |
| 5,167,732 | A | 12/1992 | Naik | |
| 5,244,515 | A | 9/1993 | Miglin | |
| 5,330,590 | A | 7/1994 | Raj | |
| 5,529,642 | A * | 6/1996 | Sugahara et al. | 148/427 |
| 5,718,867 | A | 2/1998 | Nazmy et al. | |
| 5,888,316 | A | 3/1999 | Erickson | |
| 5,916,382 | A | 6/1999 | Sato | |
| 6,344,097 | B1 | 2/2002 | Limoges et al. | |
| 6,610,154 | B2 | 8/2003 | Limoges et al. | |
| 6,702,905 | B1 | 3/2004 | Qiao | |
| 6,797,232 | B2 | 9/2004 | Speidel et al. | |
| 6,905,559 | B2 | 6/2005 | O'Hara et al. | |
| 6,908,518 | B2 | 6/2005 | Bouse et al. | |
| 7,011,721 | B2 | 3/2006 | Harris et al. | |
| 7,824,606 | B2 | 11/2010 | Heazle | |
| 8,147,749 | B2 | 4/2012 | Reynolds | |
| 8,313,591 | B2 | 11/2012 | Hirata et al. | |
| 2005/0053513 | A1 | 3/2005 | Pike | |
| 2007/0284018 | A1 | 12/2007 | Hamano et al. | |
| 2008/0126383 | A1 | 5/2008 | Perrin | |
| 2009/0044884 | A1 | 2/2009 | Toschi et al. | |
| 2009/0087338 | A1 | 4/2009 | Mitchell et al. | |
| 2009/0194266 | A1 | 8/2009 | Conrad et al. | |
| 2010/0008790 | A1 | 1/2010 | Reynolds | |
| 2010/0116383 | A1 | 5/2010 | Cloue et al. | |
| 2010/0303666 | A1 | 12/2010 | Bain et al. | |
| 2010/0303669 | A1 | 12/2010 | Pankiw et al. | |
| 2011/0272070 | A1 | 11/2011 | Jakobi et al. | |
| 2012/0279351 | A1 | 11/2012 | Gu et al. | |
| 2014/0271338 | A1 | 9/2014 | Holcomb et al. | |

OTHER PUBLICATIONS

Bruemmer, Stephen M. and Gary S. Was, Microstructural and Microchemical Mechanisms Controlling Intergranular Stress Corrosion Cracking in Light-Water-Reactor Systems, Journal of Nuclear Materials, 1994, pp. 348-363, vol. 216.

Barner, J.H. Von et al., "Vibrational Spectra of Fluoro and Oxofluoro Complexes of Nb(V) and Ta(V)", Materials Science Forum vols. 73-75 (1991) pp. 279-284 © (1991) Trans Tech Publications, Switzerland doi:10.4028/www.scientific.net/MSF.73-75.279.

Devan, Jackson H. , "Effect of Alloying Additions on Corrosion Behaviour of Nickel-Molybdenum Alloys in Fused Fluoride Mixtures", ORNL-TM-2021, vol. I, J. H. DeVan; Oak Ridge National Laboratory Central Research Library Document Collection (May 1969).

Misra, Ajay K. et al., "Fluoride Salts and Container Materials for Thermal Energy Storage Applications in the Temperature Range 973 to 1400 K", 22nd Intersociety Energy Conversion Engineering Conference cosponsored by the AIAA, ANS, ASME, SAE, IEEE, ACS, and AIChE Philadelphia, Pennsylvania, Aug. 10-14, 1987. Department of Metallurgy and Materials Science, Case Western Reserve University , Cleve.

Polyakova, L.P. et al., "Electrochemical Study of Tantalum in Fluoride and Oxofluoride Melts", J. Electrochem. Soc., vol. 141, No. 11, Nov. 1994 The Electrochemical Society Inc., pp. 2982-2988.

Singh, Raj P. , "Processing of Ta2O5 Powders for Electronic Applications", Journal of Electronic Materials, vol. 30, No. 12, 2001, pp. 1584-1594.

Yoder, Graydon L. et al., "An experimental test facility to support development of the fluoride-salt-cooled high-temperature reactor", Annals of Nuclear Energy 64 (2014) 511-517.

Khan, T., The Development and Characterization of High Performance Experimental Single Crystal Superalloy, pp. 145-155, 1984.

Weitzel, P.S., Steam Generator for Advance Ultra-Supercritical Power Plants 700-760C, Technical Paper, pp. 1-11, 2011.

* cited by examiner

| Mo | Cr | Fe | Al | Ti | Nb | W |
|---|---|---|---|---|---|---|
| 10.05 | 6.64 | 0.43 | 2.61 | | 0.39 | |
| 9.66 | 5.90 | 5.56 | 1.59 | | | |
| 10.42 | | | 5.51 | 1.92 | | |
| 14.2 | 9.47 | | 3.06 | | 1.57 | |
| 13.77 | | | | 1.68 | 0.92 | |
| 10.2 | 4.79 | | 1.27 | | 2.91 | 1.72 |
| 10.2 | 4.30 | | 2.54 | 1.90 | | |
| 14.00 | 9.32 | | 3.06 | | 1.48 | |
| 10.76 | | | 1.30 | 2.71 | | |
| 11.35 | | | 2.16 | 2.02 | | |
| 12.69 | | | 5.61 | | 0.87 | |
| 10.36 | | | 1.40 | | 3.23 | 1.85 |

CREEP-RESISTANT, COBALT-FREE ALLOYS FOR HIGH TEMPERATURE, LIQUID-SALT HEAT EXCHANGER SYSTEMS

STATEMENT REGARDING FEDERALLY SPONSORED RESEARCH

The United States Government has rights in this invention pursuant to contract no. DE-AC05-00OR22725 between the United States Department of Energy and UT-Battelle, LLC.

CROSS-REFERENCE TO RELATED APPLICATIONS

This patent application is related to U.S. patent application Ser. No. 13/833,357 entitled "High Strength Alloys for High Temperature Service in Liquid-Salt Cooled Energy Systems" filed on Mar. 15, 2013, the entire disclosure of which is incorporated herein by reference. Moreover, this patent application is related to U.S. patent application Ser. No. 13/958,672 entitled "Creep-Resistant, Cobalt-Containing Alloys for High Temperature, Liquid-Salt Heat Exchanger Systems" filed on Aug. 5, 2013, the entire disclosure of which is incorporated herein by reference.

BACKGROUND OF THE INVENTION

An ever-increasing demand for higher system thermal efficiency has necessitated the operation of power generation cycles and heat conversion systems for chemical processes at progressively higher temperatures. As system operating temperatures are increased, fewer materials with acceptable mechanical properties and environmental compatibility are known. This dearth of materials is particularly acute in applications at temperatures above 650° C. and at significant stress levels where liquid fluoride salts are favored as heat transfer media because of their high thermal capacity and low vapor pressure. There is therefore a need for structural alloys for high-temperature heat transfer applications in order to enable increased thermal efficiency of energy conversion and transport systems thereby reducing system costs as well as reducing the waste heat rejected to the environment.

Fluoride salt cooled High temperature Reactors (FHRs) potentially have attractive performance and safety attributes. Defining features of FHRs include coated particle fuel, low-pressure fluoride salt cooling, and high-temperature heat production. The FHR heat transfer technology base is derived primarily from earlier molten salt reactors and their coated particle fuel is similar to that developed for high-temperature helium-cooled reactors. The excellent heat transfer characteristics of liquid fluoride salts enable full passive safety, at almost any power scale thereby enabling large power output reactors, with less massive piping and containment structures, and consequent economies of scale. FHRs potentially have improved economics, increased safety margins, and lower water usage characteristics than conventional water-cooled reactors.

The fuel and coolants for FHRs are suitable for operation at temperatures well in excess of the upper temperature limits of available structural alloys. A limiting factor in achieving the highest possible FHR core outlet temperatures and thus thermal efficiency is the availability of structural alloys having sufficient creep strength at the required temperatures combined with suitable fluoride salt chemical compatibility as well as ease of fabrication. Hastelloy® N (trademark owned by Haynes International, Inc.) (also known as Alloy N and INOR-8), developed at Oak Ridge National laboratory (ORNL) in the 1950s and 1960s, is currently a leading candidate FHR structural alloy for operations below 700° C. Hastelloy® N is limited to use in low stress applications to a maximum temperature of about 704° C. due to insufficient creep strength at higher temperatures, is limited to use in high stress applications such as steam generator tubes to about 600° C. due to insufficient creep strength at higher temperatures, is not fully qualified to current code requirements for high temperature reactors, and is challenging to fabricate due to its work hardening characteristics. There is therefore a need for corrosion-resistant nickel-based structural alloys designed to possess good creep resistance in liquid fluorides at higher temperatures in order to provide substantial improvements in FHR economics and performance. Calculations reveal that a net thermal efficiency of greater than 50% (as compared to about 33% net thermal efficiency of existing reactors) would be likely for FHRs using a high temperature structural alloy with concurrent reductions in capital costs, waste generation, fissile material requirements, and cooling water usage.

Other applications for these alloys include concentrated solar power (CSP), and processing equipment for fluoride environments. Molten-salt power towers are envisioned as operating in excess of 650° C. to achieve efficiency and cost targets. Temperatures of up to 700° C. are anticipated with the use of commercial supercritical steam turbines, and up to 800° C. with the use of supercritical $CO_2$ Brayton cycle system. Molten salts allow for the storage of solar energy and thus, the decoupling of solar energy collection from electricity generation. At the higher temperatures, molten fluoride salts offer the advantages of high thermal capacity, high heat transfer, and low vapor pressure. The development of materials with acceptable mechanical and molten salt corrosion resistance will allow for achieving the desired efficiency and cost targets.

Development of a high temperature structural alloy tailored to the specific high temperature strength and liquid salt corrosion resistance needs of liquid fluoride salt cooled-energy systems (especially FHRs) is contemplated to be of critical importance to ensuring feasibility and performance thereof. Simultaneously achieving creep resistance and liquid fluoride salt resistance at higher temperatures is challenging because conventional additions of certain alloying elements for achieving improved creep resistance and resistance to oxidation in air are detrimental to liquid fluoride salt resistance.

In general, conventional Ni-based alloys are strengthened through a combination of solid solution strengthening and precipitation strengthening mechanisms with the latter needed to achieve higher strengths at higher temperatures. In one class of Ni-based superalloys, primary strengthening is obtained through the homogeneous precipitation of ordered, $L1_2$ structured, $Ni_3(Al,Ti,Nb)$-based intermetallic precipitates that are coherently embedded in a solid solution FCC matrix. In another class of Ni-based alloys, creep resistance is achieved through the precipitation of fine carbides ($M_{23}C_6$, $M_7C_3$, $M_6C$ where M is primarily Cr with substitution of Mo, W, for example) and carbonitrides (M(C, N) where M is primarily Nb, or Ti, for example) within the matrix, and larger carbides on grain boundaries to prevent grain boundary sliding. Moreover, high temperature oxidation resistance in these alloys is obtained through additions of Cr and Al. Existing data (shown in FIG. 1) on liquid fluoride salt resistance of Ni-based alloys show that alloys containing aluminum, and substantial amounts of chromium have lower resistance to liquid fluoride salt. Commercial Nickel-based alloys with high strengths typically contain significant amounts of Cr (greater than 15 wt. % Cr) making them unsuitable for use in contact with liquid fluoride salts. Compositions (in weight %) of several commercially produced Ni-based alloys are shown in Table 1.

Hastelloy® N is an alloy that was designed to balance resistance to liquid fluoride salt corrosion with good creep properties at temperatures up to 704° C. This alloy is a Ni—Mo alloy containing additional alloying elements with solid solution strengthening being the primary strengthening mechanism; Hastelloy® N does not have γ' precipitation strengthening. Its nominal composition is given as 71Ni-7Cr-16Mo-5Fe*-1Si*-0.8Mn*-0.2Co*-0.35Cu*-0.5W*-0.35Al+Ti*-0.08C* where * indicates maximum allowed content of the indicated elements. Hastelloy® N generally consists of the following elements to provide the corresponding benefits:

Chromium: Added to ensure good oxidation resistance but minimized to keep liquid fluoride salt corrosion within acceptable limits. Also provides solid solution strengthening. Too much addition results in excessive attack by liquid fluoride salts.

Molybdenum: Principal strengthening addition for solid solution strengthening, provides good resistance to liquid fluoride salt, and results in lower interdiffusion coefficients. Also is the primary constituent in $M_6C$ carbides. Too much addition can result in the formation of undesirable, brittle intermetallic phases.

Iron: Minimizes cost of alloy. Provides solid solution strengthening. Too much addition can destabilize austenitic matrix and decrease resistance to liquid fluoride salt.

Manganese: Stabilizes the austenitic matrix phase. Provides solid solution strengthening.

Silicon: Assists in high temperature oxidation resistance, a maximum of 1% Si may be added.

Carbon, Nitrogen: Required for the formation of carbide and/or carbonitride phases that can act as grain boundary pinning agents to minimize grain growth and to provide resistance to grain boundary sliding. Fine precipitation of carbide and/or carbonitride phases can increase high temperature strength and creep resistance.

Copper: Stabilizes the austenitic matrix, provides solid solution strengthening.

Cobalt: Provides solid solution strengthening. This element should not be present in alloys exposed to high neutron fluxes or whose corrosion products are exposed to high neutron fluxes, since these are subject to activation.

Tungsten: Provides solid solution strengthening and decreases average interdiffusion coefficient. Too much can result in the formation of brittle intermetallic phases that can be deleterious to processability.

Aluminum+Titanium are not desirable in Hastelloy® N, in order to minimize corrosion by liquid salt. Combined wt. % of Al+Ti is typically kept to less than 0.35.

FIG. 1 shows effects of alloying element additions on the depth of corrosion of Ni-alloys in 54.3LiF-41.0KF-11.2NaF-2.5$UF_4$ (mole percent) in a thermal convention loop operated between 815 and 650° C. (smaller depth of corrosion is better).

FIG. 2 shows the equilibrium phase fractions in Hastelloy® N as a function of temperature. Note that solid solution strengthening and some carbide strengthening (through $M_6C$) are the primary strengthening mechanisms active in Hastelloy® N. This limits the strength and creep resistance of Hastelloy® N at high temperatures and restricts its useful temperatures to less than about 704° C. Components such as secondary heat exchangers need to withstand large pressure differences between salt on one side of the heat exchanger wall and a gaseous fluid at higher pressures on the other side. Such components hence need materials with high temperature strength greater than that of Hastelloy® N along with good resistance to salt, good oxidation resistance, and in the case of FHRs, tolerance to nuclear irradiation. Other components need new alloys with improved creep strength at temperatures of 850° C. and higher.

BRIEF SUMMARY OF THE INVENTION

In accordance with one aspect of the present invention, the foregoing and other objects are achieved by a new, essentially Fe- and Co-free alloy that is composed essentially of, in terms of weight percent: 6.0 to 7.5 Cr, 0 to 0.15 Al, 0.5 to 0.85 Mn, 11 to 19.5 Mo, 0.03 to 4.5 Ta, 0.01 to 9 W, 0.03 to 0.08 C, 0 to 1 Re, 0 to 1 Ru, 0 to 0.001 B, 0.0005 to 0.005 N, balance Ni, the alloy being characterized by, at 850° C., a yield strength of at least 25 Ksi, a tensile strength of at least 38 Ksi, a creep rupture life at 12 Ksi of at least 25 hours, and a corrosion rate, expressed in weight loss [g/(cm$^2$ sec)]$10^{-11}$ during a 1000 hour immersion in liquid FLiNaK at 850° C., in the range of 3 to 10.

In the new alloys described herein, the range of Cr can be 6.7 to 7.1 weight percent, the range of Al can be 0.05 to 0.12 weight percent, the range of Mn can be 0.7 to 0.8 weight percent, the range of Mo can be 11.5 to 19 weight percent, the range of Ta can be 0.4 to 3.1 weight percent, and/or the range of C can be 0.04 to 0.06 weight percent.

Figure 1:
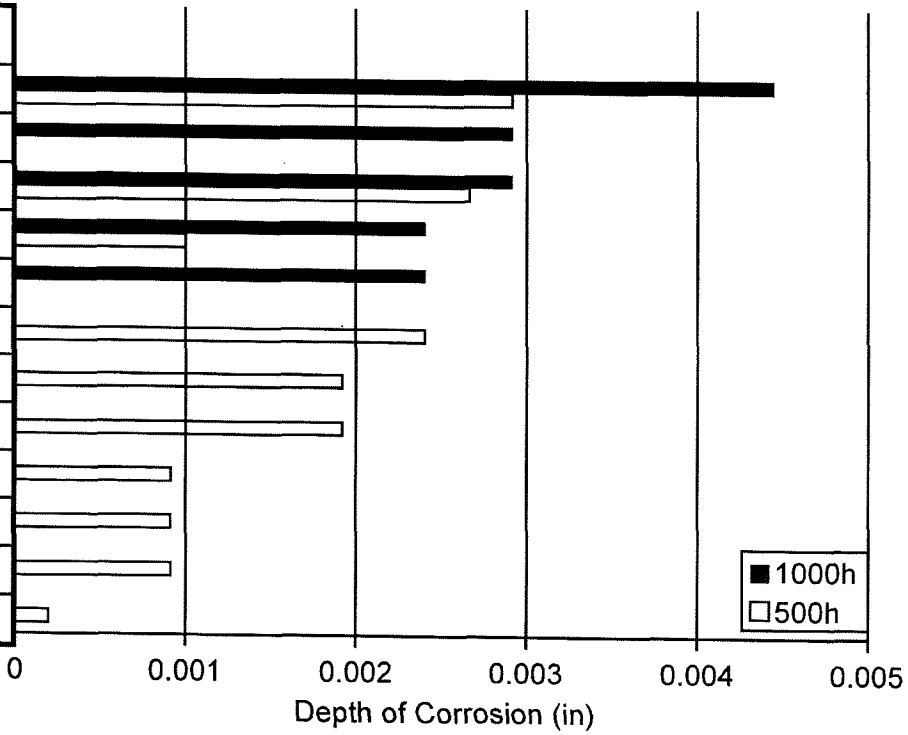
FIG. 1 is a combination table and bar graph showing effects of alloying element additions on the depth of corrosion of Ni-alloys in 54.3LiF-41.0KF-11.2NaF-2.5$UF_4$ (mole percent) in a thermal convention loop operated between 815 and 650° C.
Figure 2:
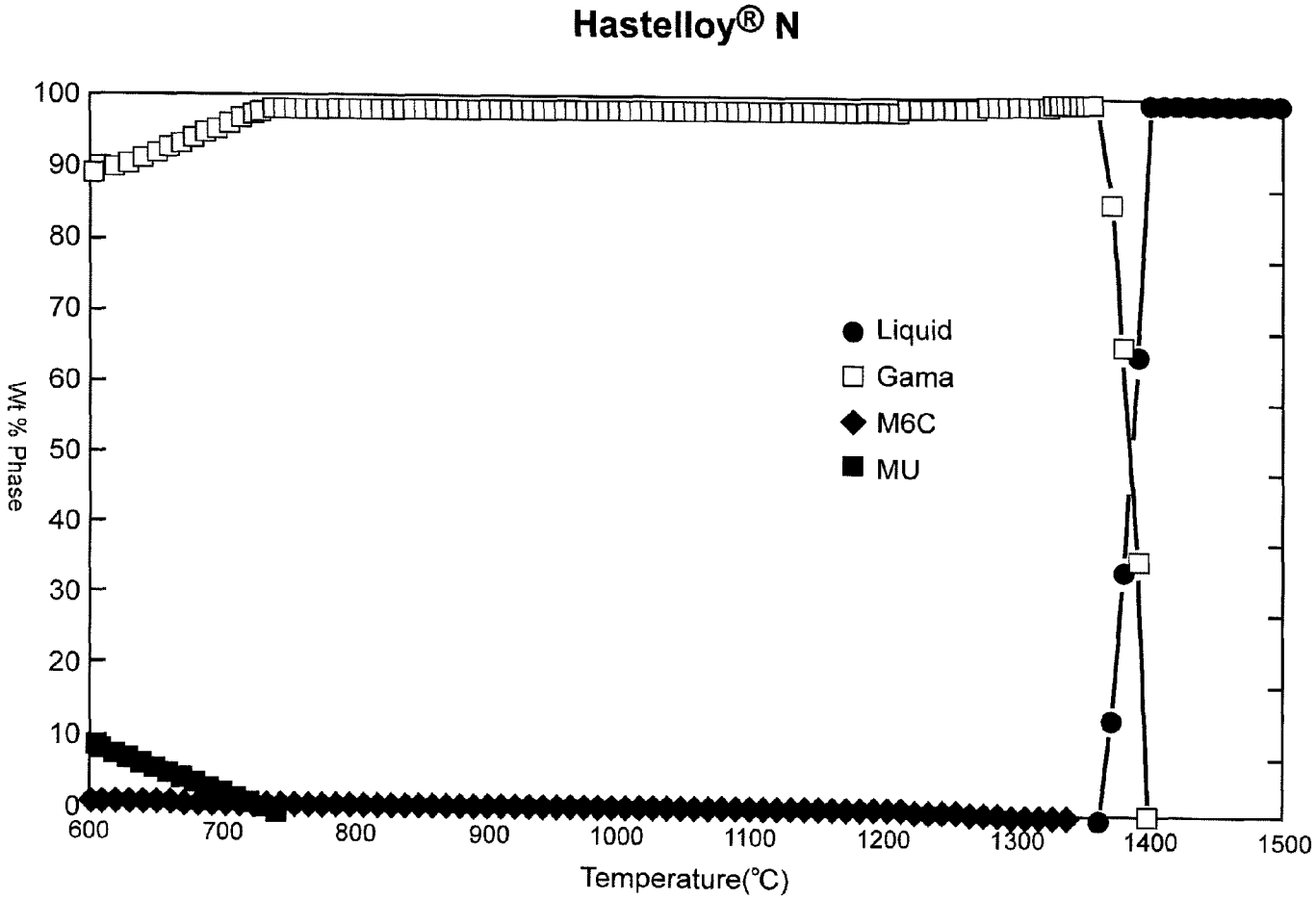
FIG. 2 is a graph showing phase equilibria for a typical composition of Hastelloy® N as a function of temperature (nitrogen and boron are not included in the calculations).

For a better understanding of the present invention, together with other and further objects, advantages and capabilities thereof, reference is made to the following disclosure and appended claims in connection with the above-described drawings.

DETAILED DESCRIPTION OF THE INVENTION

New, essentially Fe-free, Co-free, solid-solution-strengthened alloys having improved high temperature strength and creep resistance; general composition limits are shown in Table 2. The primary strengthening mechanism in the new alloys is solid solution strengthening with a small amount of carbides used to control microstructural aspects such as grain size, and grain boundary sliding. Moreover, the new alloys exhibit an advantageously lower average interdiffusion coefficient in the matrix. The new alloys can include additions of Mo, Ta, W, Re, and Ru to provide solid solution strengthening in addition to decreasing the average interdiffusion coefficient in the matrix. The skilled artisan will recognize that a lower interdiffusion rate results in, at high temperatures, lower coarsening rate of carbides, improved creep properties, lower oxidation rate, and lower corrosion rate.

Computational design was used to ensure that formation of brittle intermetallic phases that form in the new alloys is very low or zero weight % in the operating temperature range of contemplated greatest interest (750 to 950° C.). Moreover, amounts of Ta and W are restricted in the new alloys in order to retain advantageously high temperature ductility. The primary advantage of solid solution strengthened alloys is microstructural stability.

Strengthening of the new alloys is primarily obtained through the presence of solute elements in solid solution that are different in size, and chemical composition from the majority element (solvent, in this case Ni). Hence, strengthening is not primarily obtained through the presence of precipitates. Therefore, microstructural changes such as coarsening of precipitates are not considered to be particularly relevant in determining the properties of the new alloys.

Solid-solution-strengthening enables simpler fabrication of the new alloys into various applications by methods such as forming and welding. Solid solution strengthened alloys are generally used in applications that need relatively lower yield and tensile strengths, and lower creep resistance when compared to precipitation-strengthened alloys, but require stable properties for extended periods of time (25-80 years).

Broadest constituent ranges for alloys of the present invention are set forth in Table 2. Some examples thereof are set forth in Table 3, with Hastelloy® N for comparison. It is contemplated that alloys of the present invention may contain up to 5% Fe with concomitant reduction in some beneficial properties, such as creep resistance and oxidation resistance.

Examples

Alloys 141, 142, 143, 144 and 145 shown in Table 3 were made using well known, conventional methods. Vacuum arc cast ingots were annealed at 1200° C. in an inert gas environment (vacuum can also be used). The ingots were then hot-rolled into plates for mechanical testing. A solution annealing treatment was performed at 1150° C. for 1 hour. Thus all the alloys can be cast, heat-treated, and mechanically processed into plates and sheets. The skilled artisan will recognize that other, conventional heat-treatment schedules can be used.

Figure 3:
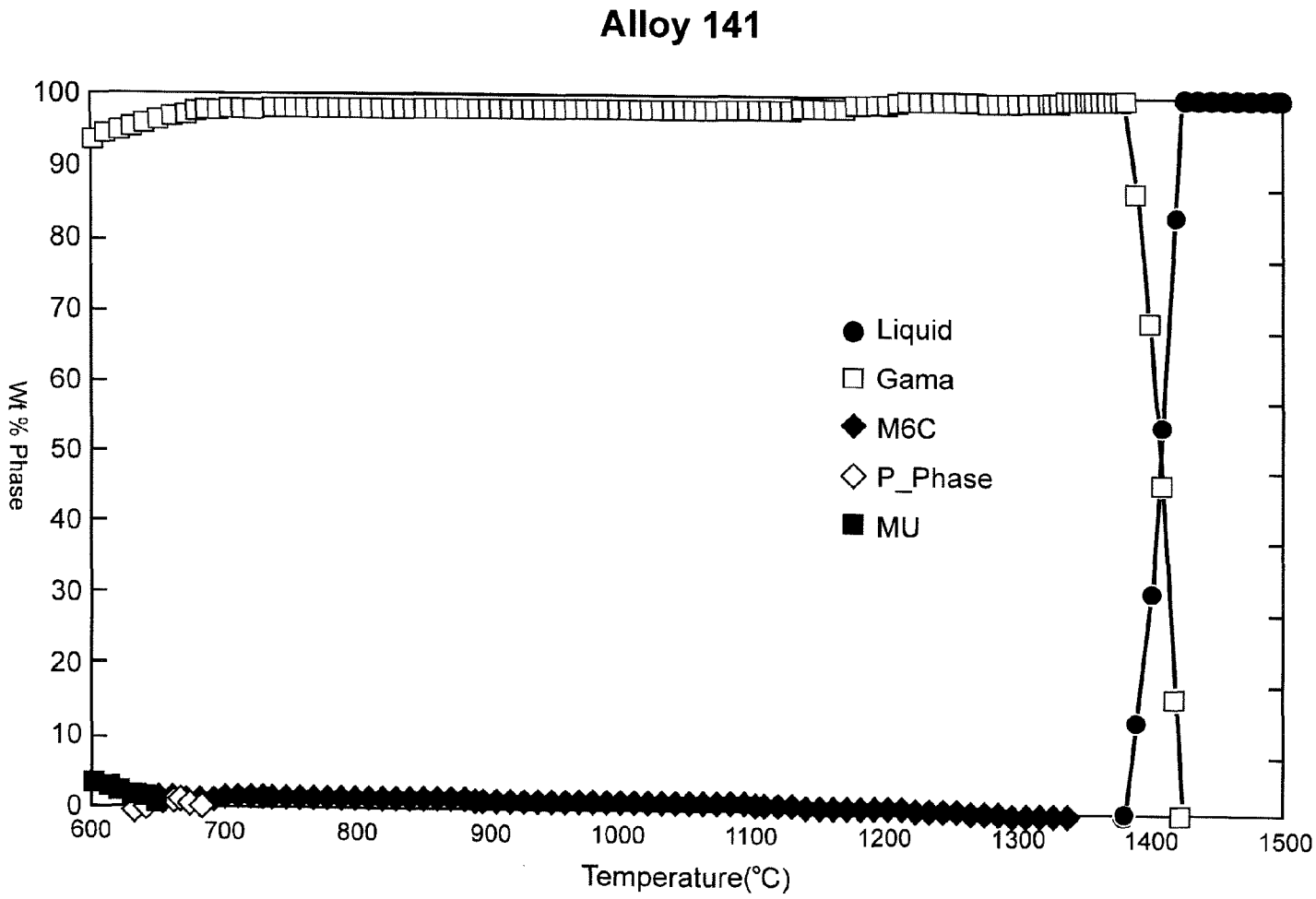
FIG. 3 is a graph showing phase equilibria for Alloy 141 as a function of temperature (nitrogen and boron are not included in the calculations).
Figure 4:
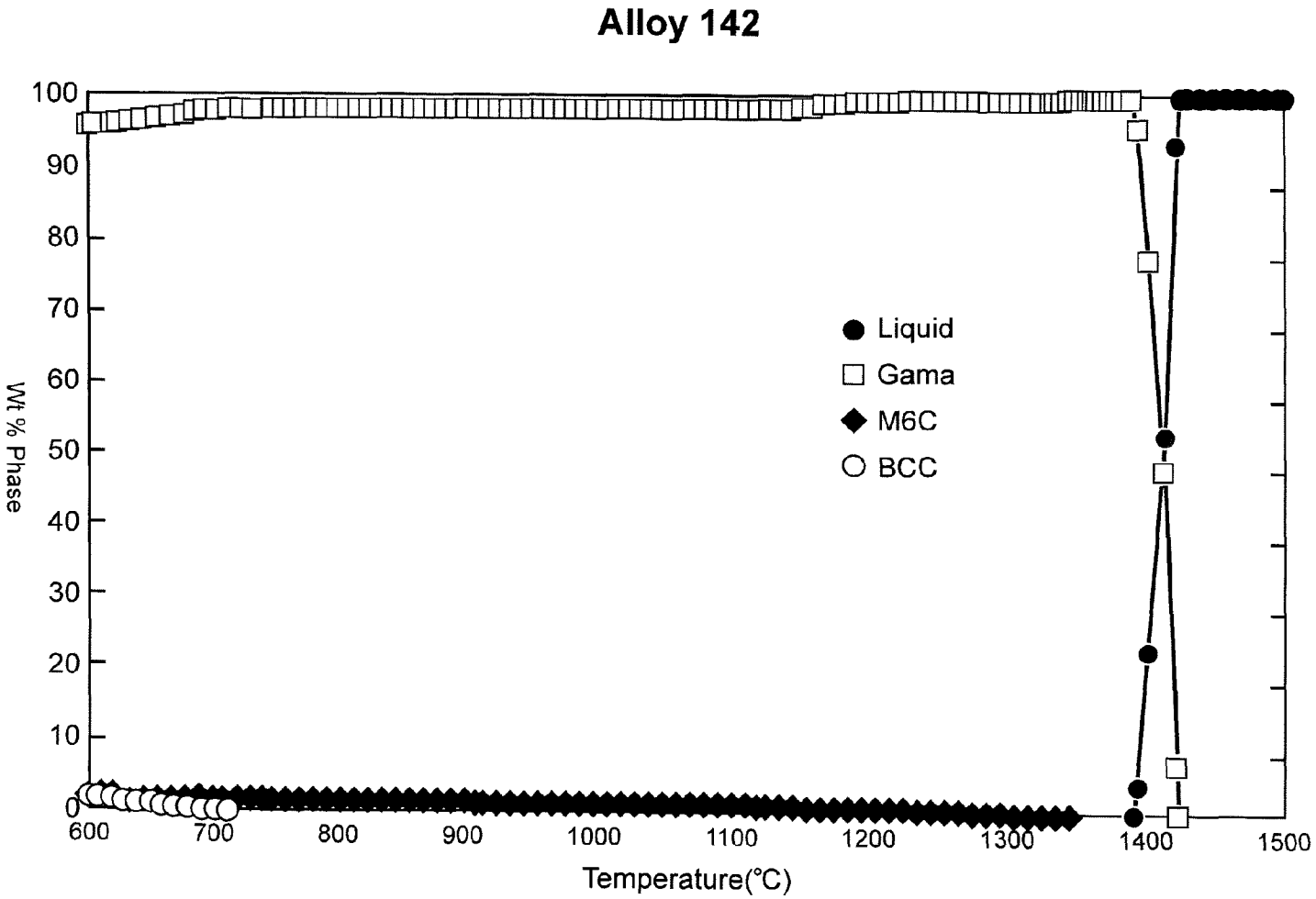
FIG. 4 is a graph showing phase equilibria for Alloy 142 as a function of temperature (nitrogen and boron are not included in the calculations).
Figure 5:
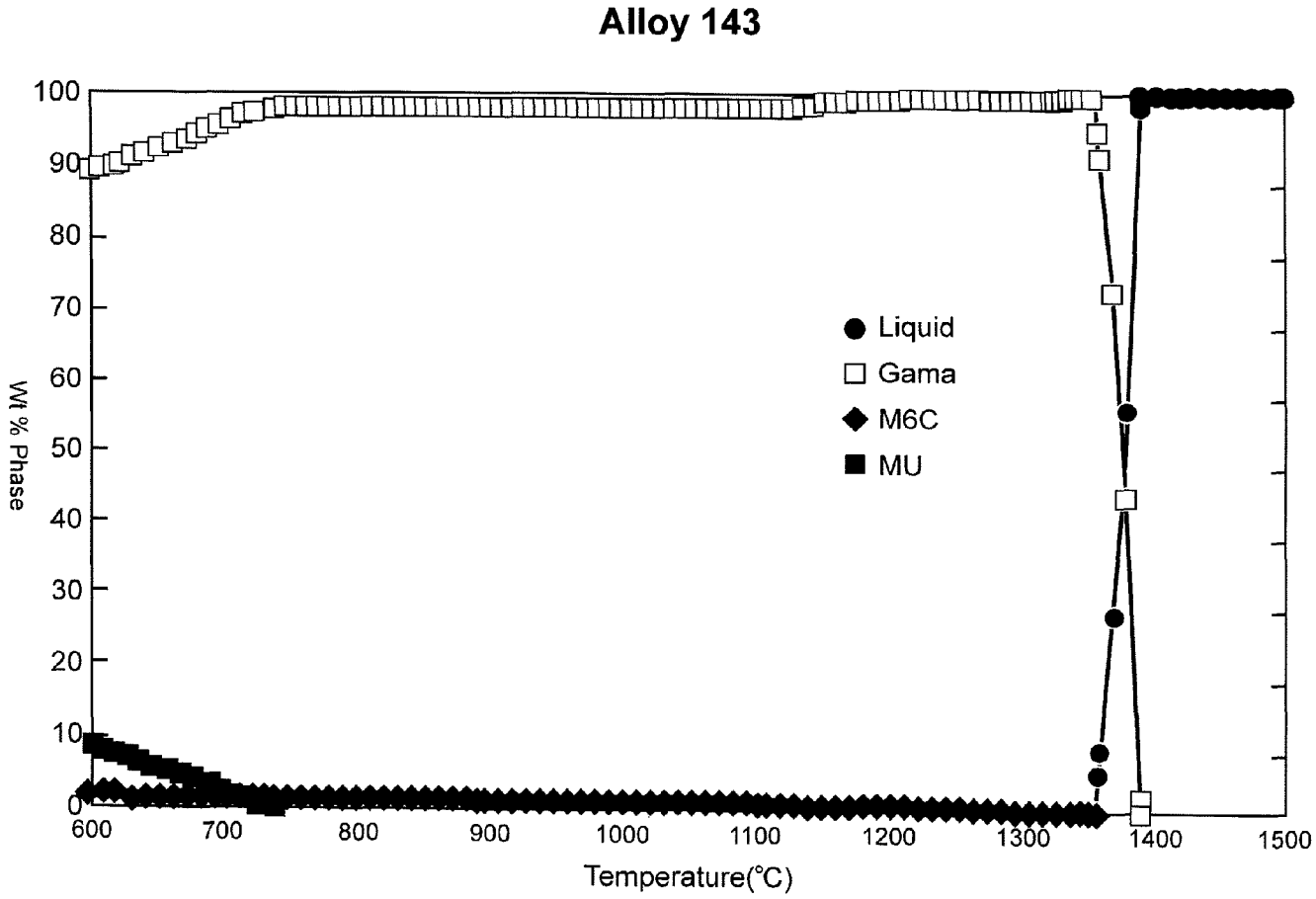
FIG. 5 is a graph showing phase equilibria for Alloy 143 as a function of temperature (nitrogen and boron are not included in the calculations).
Figure 6:
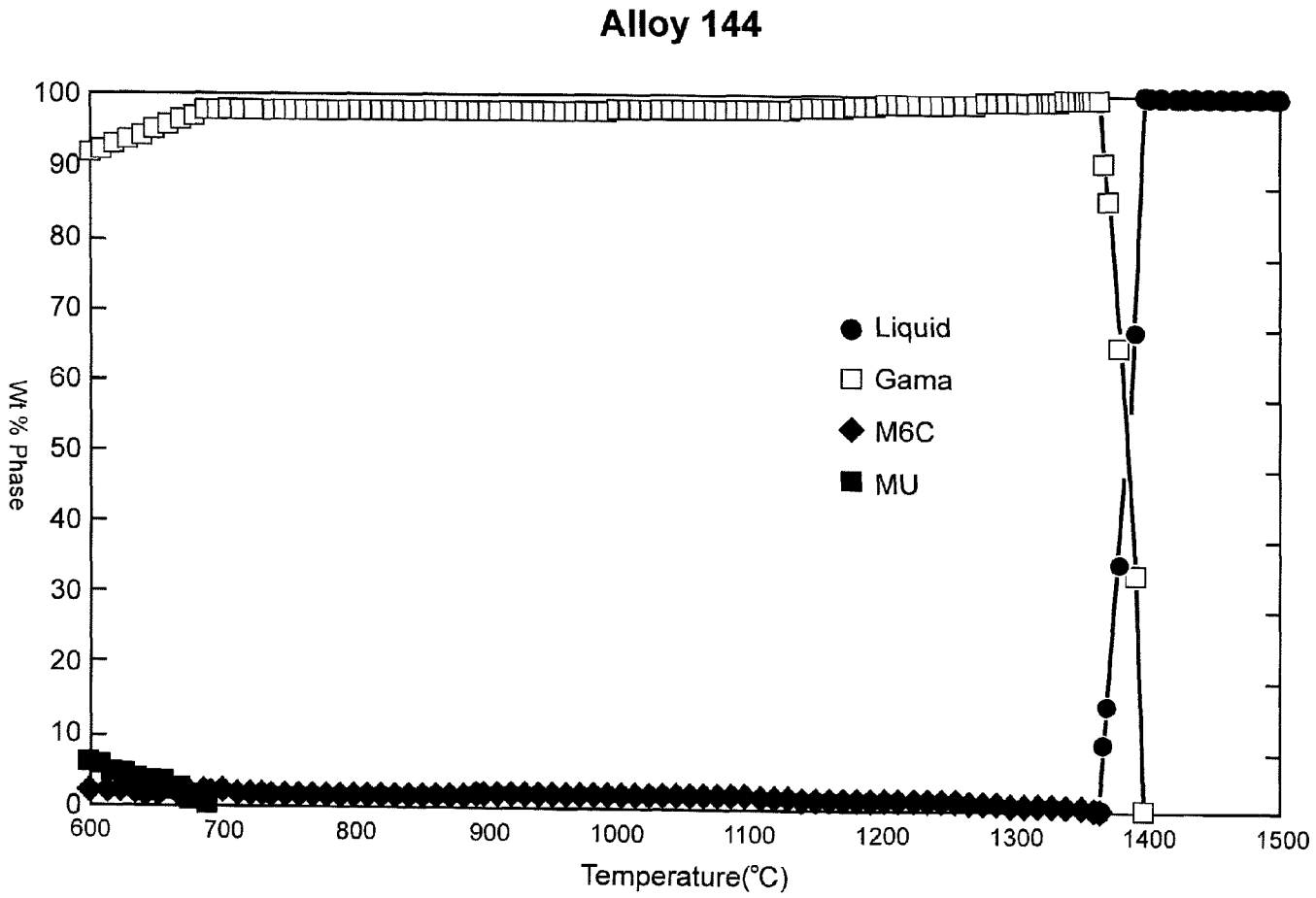
FIG. 6 is a graph showing phase equilibria for Alloy 144 as a function of temperature (nitrogen and boron are not included in the calculations).
Figure 7:
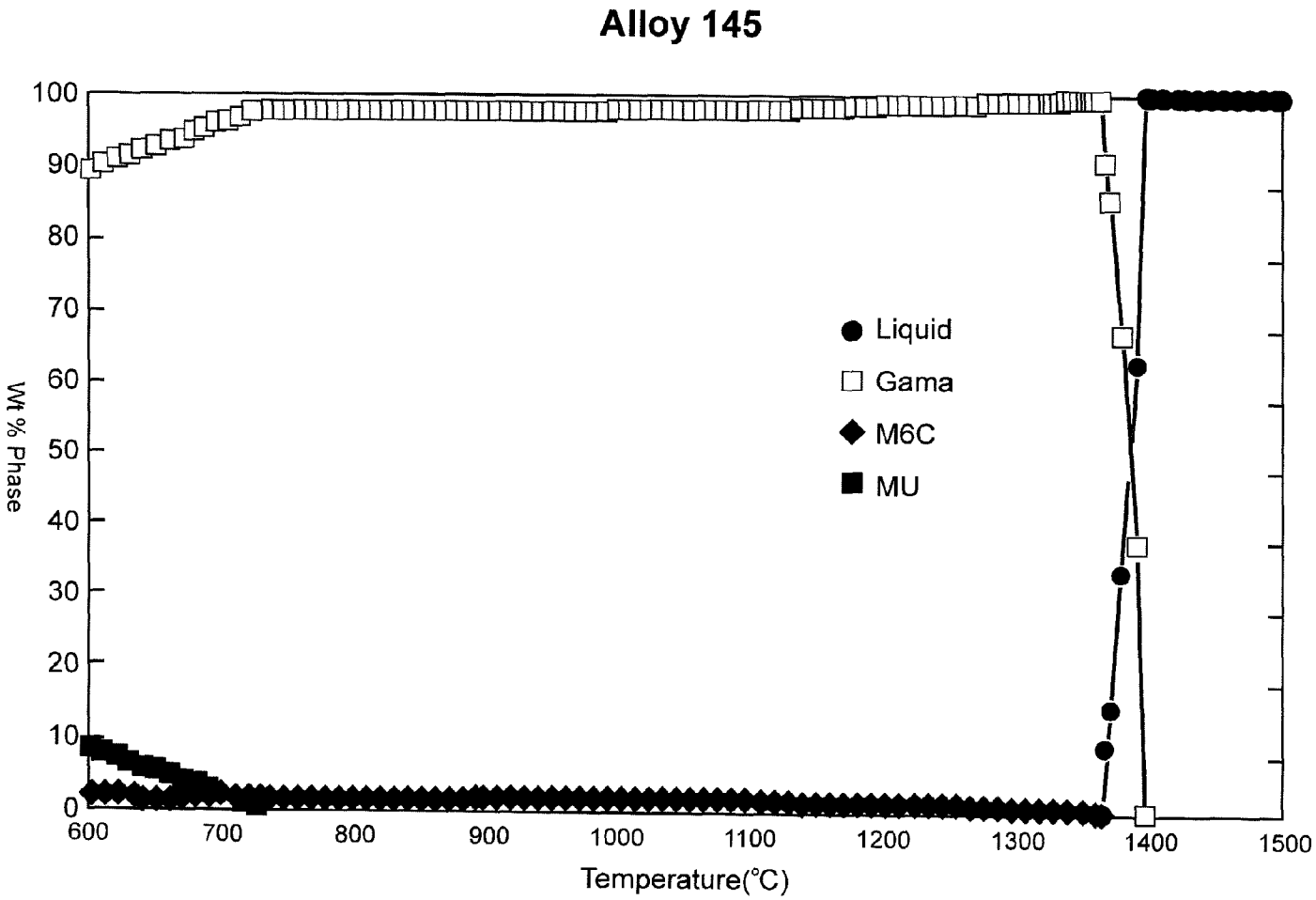
FIG. 7 is a graph showing phase equilibria for Alloy 145 as a function of temperature (nitrogen and boron are not included in the calculations).

FIGS. 3-6 show the results from equilibrium calculations obtained from the computational thermodynamics software JMatPro v 6.2. Actual compositions were used for all the calculations.

Table 4 shows equilibrium wt. % of phases present in alloys at 850° C., which range from 1.12 to 2.2 wt. % $M_6C$. Typical wt. % $M_6C$ of alloys of the present invention are contemplated to be in the range of 1 to 2.5. It can be seen that alloys of the present invention are essentially free of MC-type carbides.

Yield and tensile strengths have been measured at 850° C. and compared with the baseline properties of Hastelloy® N and are shown in Table 5. Note that the tensile strengths of the new alloys at 850° C. in the solution annealed condition are roughly comparable to or in some cases, better than that of Hastelloy N. Typical yield strengths of alloys of the present invention are contemplated to be at least 25 Ksi, preferably at least 27 Ksi. Typical tensile strengths of alloys of the present invention are contemplated to be at least 38 Ksi, preferably at least 40 Ksi.

Creep rupture life has been measured in the solution annealed condition at 850° C. at a stress level of 12 Ksi with the new alloys showing improvements in rupture lives of about 645% to 1067% as shown in Table 6. Creep rupture lives of alloys of the present invention are contemplated to be at least 25 hours, preferably at least 28 hours.

Resistances to liquid salt corrosion were measured by placing the alloy specimens of measured dimensions and weight in sealed molybdenum capsules in contact with a fixed amount of FLiNaK, a liquid salt heat exchange medium. The molybdenum capsules were enclosed in outer capsule to minimize high temperature air oxidation and heated in a furnace at 850° C. for 1,000 hours. After exposure, the capsules were opened and the specimens cleaned, weighed and their dimension measured. Corrosion resistance to liquid fluoride salt was evaluated based on normalized weight change and metallography and scanning electron microscopy. Results obtained, presented in Table 7, demonstrate that these alloys all have very low corrosion rates in these isothermal tests. Typical corrosion rates of alloys of the present invention, expressed in weight loss $[g/(cm^2\ sec)]\times10^{-11}$ during a 1000 hour immersion in liquid FLiNaK at 850° C., are contemplated to be in the range of about 3 to about 10, preferably no more than about 9.3. Thus a balance has been struck between improved mechanical properties and resistance to attack by liquid fluoride salt.

Table 8 shows the corrosion susceptibility index which quantifies the susceptibility to corrosion of the alloys shown in Table 3 by liquid fluoride salts, specifically FLiNaK. For this purpose, we define the corrosion susceptibility index as $$CSI = \frac{\%\ Al + \%\ Cr + \%\ Ti + \%\ Nb + \%\ Hf + \%\ Ta}{\%\ Ni + \%\ Fe + \%\ Co + \%\ Mn + \%\ Mo + \%\ W + \%\ Re + \%\ Ru}$$

where % refers to atomic percent of the element present in the alloy. It has been observed that for these alloys, CSI should be greater than about 0.09 and less than about 0.12 in addition to maintaining the elements in the preferred ranges. This results in the optimum combination of mechanical properties (high temperature strength and creep resistance) and resistance to fluoride salts.

Tables 1-8 follow.

While there has been shown and described what are at present considered to be examples of the invention, it will be obvious to those skilled in the art that various changes and modifications can be prepared therein without departing from the scope of the inventions defined by the appended claims.

TABLE 1

Compositions of several commercial Ni-based alloys (in weight %).

| Alloy | C | Si | Mn | Al | Co | Cr | Cu | Fe | Mo | Nb | Ni | Ta | Ti | W | Zr |
|---|---|---|---|---|---|---|---|---|---|---|---|---|---|---|---|
| X750 | 0.03 | 0.09 | 0.08 | 0.68 | 0.04 | 15.7 | 0.08 | 8.03 | — | 0.86 | Bal | 0.01 | 2.56 | — | — |
| Nimonic 80A | 0.08 | 0.1 | 0.06 | 1.44 | 0.05 | 19.6 | 0.03 | 0.53 | — | — | Bal | — | 2.53 | — | — |
| IN 751 | 0.03 | 0.09 | 0.08 | 1.2 | 0.04 | 15.7 | 0.08 | 8.03 | — | 0.86 | Bal | 0.01 | 2.56 | — | — |
| Nimonic 90 | 0.07 | 0.18 | 0.07 | 1.4 | 16.1 | 19.4 | 0.04 | 0.51 | 0.09 | 0.02 | Bal | — | 2.4 | — | 0.07 |
| Waspaloy | 0.03 | 0.03 | 0.03 | 1.28 | 12.5 | 19.3 | 0.02 | 1.56 | 4.2 | — | Bal | — | 2.97 | — | 0.05 |
| Rene 41 | 0.06 | 0.01 | 0.01 | 1.6 | 10.6 | 18.4 | 0.01 | 0.2 | 9.9 | — | Bal | — | 3.2 | — | — |
| Udimet 520 | 0.04 | 0.05 | 0.01 | 2.0 | 11.7 | 18.6 | 0.01 | 0.59 | 6.35 | — | Bal | — | 3.0 | | |
| Udimet 720 | 0.01 | 0.01 | 0.01 | 2.5 | 14.8 | 15.9 | 0.01 | 0.12 | 3.0 | 0.01 | Bal | — | 5.14 | 1.23 | 0.03 |
| Alloy 617 | 0.07 | 0 | 0 | 1.2 | 12.5 | 22 | 0 | 1 | 9 | 0 | 54 | 0 | 0.3 | 0 | 0 |

TABLE 2

Compositions of new alloys (analyzed compositions in wt. %)

| Element | Minimum wt. % | Maximum wt. % |
|---|---|---|
| Cr | 6.0 | 7.5 |
| Al | 0 | 0.15 |
| Mn | 0.50 | 0.85 |
| Mo | 11 | 19.5 |
| Ta | 0.3 | 4.5 |
| W | 0.01 | 9 |
| C | 0.03 | 0.08 |
| Re | 0 | 1 |
| Ru | 0 | 1 |
| B | 0 | 0.001 |
| N | 0.0005 | 0.005 |
| Ni | Balance | |
| Fe | Essentially 0 | |
| Co | Essentially 0 | |

TABLE 5

Yield and Tensile Strengths of Alloys at 850° C.

| Alloy | Yield Strength | Tensile strength |
|---|---|---|
| Hastelloy ® N | 35.29 | 45.70 |
| Alloy 141 | 38.2 | 45.7 |
| Alloy 142 | 27.4 | 43.8 |
| Alloy 143 | 37.8 | 43.9 |
| Alloy 144 | 35.0 | 40.2 |
| Alloy 145 | 34.1 | 51.8 |

TABLE 3

Compositions of new alloys compared to Hastelloy ® N (analyzed compositions in wt. %)

| Alloy | Ni | Fe | Al | Co | Cr | Mn | Mo | Ti | Nb | Re | Ru | Hf | Ta | W | C | B** | N** | Total |
|---|---|---|---|---|---|---|---|---|---|---|---|---|---|---|---|---|---|---|
| Hastelloy ® N* | 72.17 | 4.03 | <0.01 | 0.15 | 6.31 | 0.53 | 16.11 | — | — | — | — | — | — | 0.06 | 0.03 | 0.01 | — | |
| Alloy 141 | 68.479 | 0 | 0.09 | 0 | 6.94 | 0.77 | 11.78 | 0 | 0 | 0 | 0 | 0 | 3.97 | 7.92 | 0.051 | 0 | 0.0005 | 100 |
| Alloy 142 | 74.8115 | 0 | 0.10 | 0 | 6.97 | 0.70 | 12.33 | 0 | 0 | 0.96 | 0 | 0 | 2.13 | 1.95 | 0.048 | 0 | 0.0002 | 100 |
| Alloy 143 | 70.6022 | 0 | 0.09 | 0 | 7.03 | 0.79 | 17.38 | 0 | 0 | 0 | 0 | 0 | 4.04 | 0.02 | 0.047 | 0 | 0.0005 | 100 |
| Alloy 144 | 72.4752 | 0 | 0.10 | 0 | 6.98 | 0.76 | 19.09 | 0 | 0 | 0 | 0 | 0 | 0.53 | 0.01 | 0.054 | 0 | 0.0005 | 100 |
| Alloy 145 | 70.9994 | 0 | 0.10 | 0 | 7.00 | 0.75 | 19.37 | 0 | 0 | 0 | 0.76 | 0 | 0.49 | 0.48 | 0.05 | 0 | 0.0003 | 100 |

*Hastelloy ® N also contains 1 Si, 0.35 Cu, 0.5 max of Al + Ti

**Boron and Nitrogen are not included in the equilibrium calculations

TABLE 4

Equilibrium wt. % of Phases Present in Alloys at 850° C.

| Alloy | Wt. % γ | Wt. % MC | Wt. % $M_6C$ |
|---|---|---|---|
| Hastelloy ® N | 98.77 | 0 | 1.23 |
| Alloy 141 | 97.88 | 0 | 2.12 |
| Alloy 142 | 98.88 | 0 | 1.12 |
| Alloy 143 | 98.1 | 0 | 1.9 |
| Alloy 144 | 97.8 | 0 | 2.2 |
| Alloy 145 | 97.96 | 0 | 2.04 |

TABLE 6

Creep rupture lives of alloys at 850° C., at a stress of 12 Ksi and improvement over the base alloy Alloy N.

| Alloy | Creep Rupture Life (Hours) | % Improvement in creep rupture life |
|---|---|---|
| Hastelloy ® N | 3.77 (average of three) | 0 |
| Alloy 141 | 42.3 | 1022 |
| Alloy 142 | 28.1 | 645 |
| Alloy 143 | 44 | 1067 |
| Alloy 144 | 30.1 | 698 |
| Alloy 145 | 40.1 | 964 |

TABLE 7

| Corrosion Rate (Weight Loss) Measured During a 1000 hour immersion in liquid FLiNaK at 850° C. | |
|---|---|
| Alloy | Corrosion rate [g/(cm$^2$sec)]$10^{-11}$ |
| Hastelloy ® N | 1.21 |
| Alloy 141 | 9.26 |
| Alloy 142 | 7.11 |
| Alloy 143 | 8.06 |
| Alloy 144 | 3.63 |
| Alloy 145 | 3.87 |

TABLE 8

Composition of alloys in at. % and the calculation of the Corrosion Susceptibility Index (CSI)

| Alloy | Ni | Fe | Al | Co | Cr | Mn | Mo | Ta | Re | Ru | W | C | CSI |
|---|---|---|---|---|---|---|---|---|---|---|---|---|---|
| Hastelloy ® N* | 75.735 | 4.443 | 0 | 0.157 | 7.473 | 0.594 | 10.34 | 0 | | | 0.02 | 0.154 | 0.081861 |
| Alloy 141 | 77.29 | 0 | 0.221 | 0 | 8.842 | 0.928 | 8.134 | 1.453 | 0 | 0 | 2.854 | 0.281 | 0.11788 |
| Alloy 142 | 80.41 | 0 | 0.234 | 0 | 8.456 | 0.804 | 8.108 | 0.743 | 0.325 | 0 | 0.669 | 0.252 | 0.10444 |
| Alloy 143 | 76.945 | 0 | 0.213 | 0 | 8.648 | 0.92 | 11.588 | 1.428 | 0 | 0 | 0.007 | 0.25 | 0.11501 |
| Alloy 144 | 77.513 | 0 | 0.233 | 0 | 8.427 | 0.868 | 12.49 | 0.184 | | | 0.003415 | 0.282 | 0.09732 |
| Alloy 145 | 76.535 | 0 | 0.234 | 0 | 8.518 | 0.864 | 12.774 | 0.171 | 0 | 0.476 | 0.165 | 0.263 | 0.09826 |

*A representative composition is used for comparison.

What is claimed is:

1. An essentially Fe- and Co-free alloy for use in contact with liquid fluoride salts consisting essentially of, in terms of weight percent:

Cr 6.0 to 7.5
Al 0 to 0.15
Mn 0.5 to 0.85
Mo 11 to 19.5
Ta 0.3 to 4.5
W 0.01 to 9
C 0.03 to 0.08
Re 0 to 1
Ru 0 to 1
B 0 to 0.001
N 0.0005 to 0.005
Ni balance, wherein Mo+W is 19.85 or less, and Mo+Cr is 26.37 or less;

said alloy being characterized by, at 850° C., a yield strength of at least 25 Ksi, a tensile strength of at least 38 Ksi, a creep rupture life at 12 Ksi of at least 25 hours, and a corrosion rate, expressed in weight loss [g/(cm$^2$ sec)]$10^{-11}$ during a 1000 hour immersion in liquid FLiNaK at 850° C., in a range of 3 to 10, said alloy has a microstructure consisting of γ phase and $M_6C$, wherein $M_6C$ is 1 to 2.5 in wt %, and having a corrosion susceptibility index between 0.09 and 0.12.

2. An alloy in accordance with claim 1 wherein the range of Cr is 6.7 to 7.1 weight percent.

3. An alloy in accordance with claim 1 wherein the range of Al is 0.05 to 0.12 weight percent.

4. An alloy in accordance with claim 1 wherein the range of Mn is 0.7 to 0.8 weight percent.

5. An alloy in accordance with claim 1 wherein the range of Mo is 11.5 to 19 weight percent.

6. An alloy in accordance with claim 1 wherein the range of Ta is 0.4 to 4.1 weight percent.

7. An alloy in accordance with claim 1 wherein the range of C is 0.04 to 0.06 weight percent.

8. An alloy in accordance with claim 1 wherein said yield strength is at least 27 Ksi.

9. An alloy in accordance with claim 1 wherein said tensile strength is at least 40 Ksi.

10. An alloy in accordance with claim 1 wherein said creep rupture life is at least 28 hours.

11. An alloy in accordance with claim 1 wherein said corrosion rate is no more than 9.3.

12. An alloy in accordance with claim 1 wherein said alloy is further characterized by a wt. % $M_6C$ in the range of 1.12 to 2.2.

* * * * *